US006682581B1

(12) United States Patent
Speidel

(10) Patent No.: US 6,682,581 B1
(45) Date of Patent: Jan. 27, 2004

(54) NICKEL-POOR AUSTENITIC STEEL

(75) Inventor: Markus Speidel, Birmenstorf (CH)

(73) Assignee: BASF Aktiengesellschaft, Ludwigshafen (DE)

( * ) Notice: Subject to any disclaimer, the term of this patent is extended or adjusted under 35 U.S.C. 154(b) by 0 days.

(21) Appl. No.: 09/979,670

(22) PCT Filed: May 26, 2000

(86) PCT No.: PCT/EP00/04824

§ 371 (c)(1),
(2), (4) Date: Nov. 26, 2001

(87) PCT Pub. No.: WO00/73528

PCT Pub. Date: Dec. 7, 2000

(30) Foreign Application Priority Data

May 26, 1999 (CH) ..... 0981/99

(51) Int. Cl.[7] ..... B22F 1/00

(52) U.S. Cl. ..... 75/252; 419/26; 419/36; 419/38

(58) Field of Search ..... 75/252, 243, 244, 75/246; 419/36, 38, 26

(56) References Cited

U.S. PATENT DOCUMENTS

| | | | | |
|---|---|---|---|---|
| 3,904,401 A | | 9/1975 | Mertz | |
| 3,936,297 A | * | 2/1976 | Harltine, III | 420/59 |
| 3,943,010 A | | 3/1976 | Hartline | 148/31.5 |
| 3,989,474 A | * | 11/1976 | Goller et al. | 428/683 |
| 4,116,683 A | | 9/1978 | Nikolov | |
| 4,217,136 A | | 8/1980 | Hartline | 75/128 |
| 5,175,900 A | | 1/1993 | Hadgis | |
| 5,198,489 A | | 3/1993 | Sterzel | 524/439 |
| 5,338,508 A | * | 8/1994 | Nitta et al. | 420/120 |
| 5,362,791 A | | 11/1994 | Ebenhoech | 524/440 |
| 5,427,600 A | * | 6/1995 | Itoh et al. | 75/232 |
| 5,714,115 A | | 2/1998 | Speidel | 420/65 |
| 5,848,350 A | * | 12/1998 | Bulger | 419/36 |
| 5,860,055 A | | 1/1999 | Hesse | |
| 6,093,233 A | * | 7/2000 | Magnin | 75/244 |
| 6,325,766 B1 | * | 12/2001 | Anderson et al. | 600/585 |

FOREIGN PATENT DOCUMENTS

| | | |
|---|---|---|
| BE | 675 396 | 7/1966 |
| DE | 266 900 | 12/1968 |
| DE | 42 42 757 | 3/1994 |
| DE | 196 07828 | 10/1996 |
| EP | 422 360 | 4/1991 |
| EP | 432 434 | 6/1991 |
| EP | 640 695 | 3/1995 |
| EP | 875 591 | 11/1998 |
| JP | 07/157847 | 6/1995 |

OTHER PUBLICATIONS

Pat.Abs.of Japan,61227154.
Pat.Abs.of Japan,02156046.
Translation of EP 413 231 (OZ 0050/41335).
Ulmann's Ency.Ind.Chem,6thEd.,Technology of Iron Production.
Competitive advantages by near–net–shape mfg.,Baehre et al. 238–247.
Novel Materials in Metal Injection Moulding, Wohlfrom et al.54–61.
BASF OZ 49590 = DE 198 55 422.

* cited by examiner

*Primary Examiner*—Ngoclan Mai
(74) *Attorney, Agent, or Firm*—Keil & Weinkauf

(57) ABSTRACT

Low-nickel austenitic steel which contains iron and the following components:

Manganese: less than 17.0% by weight;

Chromium: more than 21.0 and not more than 26.0% by weight;

Molybdenum: less than 1.50% by weight;

Nitrogen: more than 0.70 and not more than 1.70% by weight; and

Carbon: more than 0.11 and not more than 0.70% by weight and its production and use.

7 Claims, 1 Drawing Sheet

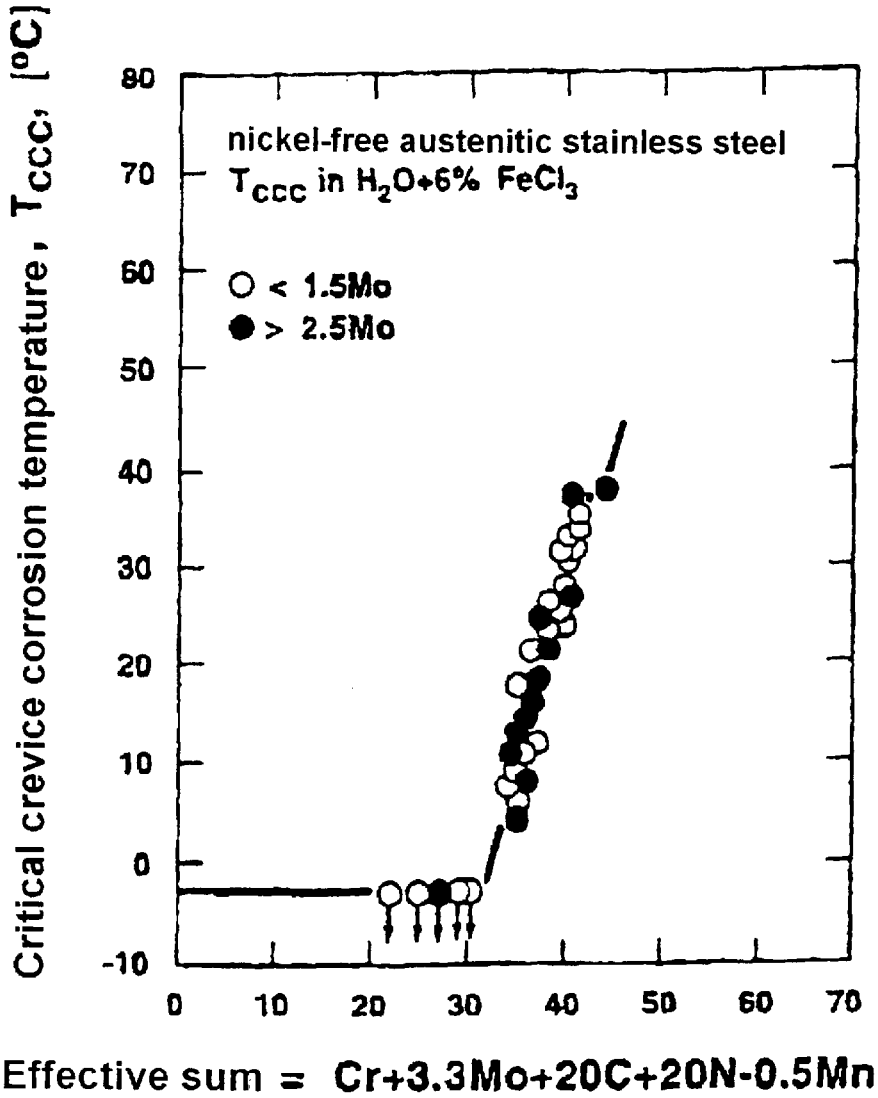
nickel-free austenitic stainless steel
$T_{CCC}$ in $H_2O$+6% $FeCl_3$
○ < 1.5Mo
● > 2.5Mo
Critical crevice corrosion temperature, $T_{CCC}$, [°C]
80
70
60
50
40
30
20
10
0
-10
0
10
20
30
40
50
60
70
Effective sum = Cr+3.3Mo+20C+20N-0.5Mn

NICKEL-POOR AUSTENITIC STEEL

The present invention relates to a low-nickel austenitic steel, in particular a low-nickel, low-molybdenum, low-manganese and low-copper austenitic steel, and its use. The present invention furthermore relates to processes for the production of articles consisting of such steels.

Here, as usual, the term steel denotes iron-containing alloys and includes carbon-containing iron. Strictly, austenite is a high-temperature modification of iron having a face centered cubic crystal structure (γ-iron), which is thermally dynamically stable between 740° C. and 1 538° C. and contains from 0 to not more than 2.1% by weight (at 1 153° C.) of carbon in the form of a solid solution. Usually, however, all steels which have a face centered cubic crystal lattice are referred to as austenitic steels or austenites. The face centered cubic austenite structure is required for many applications of steels or at least is advantageous compared with other modifications (for example ferritic or martensitic steels); austenite is, for example, nonferromagnetic, which makes it possible to use austenitic steels for electrical or electronic components or other applications where the occurrence of repulsive or attractive magnetic forces is undesirable, for example in clocks and watches. However, since austenite is a high-temperature modification and is thermodynamically unstable at lower temperatures, an austenitic steel must be stabilized to conversion into other modifications so that it retains its desired austenitic properties at normal temperature too. This can be effected, for example, by adding alloy elements which are known as stabilizers of the austenite structure. The alloy element most frequently used for this purpose is nickel, typically in an amount of from 8 to 10% by weight.

Other alloy components are used for influencing other properties of the steel (for example corrosion stability and stability to wear, hardness, strength or ductility) in a desired manner. However, the use of specific alloy components also frequently leads—generally as a function of the amount—to certain disadvantages, which can be counteracted to a certain extent by adapting the alloy composition. For example, carbon and manganese generally help to stabilize the austenite structure but, in excessive amounts, reduce the corrosion stability. Silicon is frequently an unavoidable impurity and is sometimes also deliberately added as an oxygen scavenger but promotes the formation of δ-ferrite. Chromium, molybdenum and tungsten make a decisive contribution toward corrosion stability but likewise promote the formation of δ-ferrite. Nitrogen in turn stabilizes the austenite structure and increases the corrosion stability but excessively high nitrogen contents reduce the ductility of the steel. One difficulty in the optimization of steel compositions is that the properties of the steel do not change linearly with the content of specific alloy components, but very large abrupt changes in the material properties can occur even with small changes in the composition. A further disadvantage of using nonferrous metals as alloy components is in general their comparatively high price.

Steels and their production have long been known. A comprehensive overview of the technology of steels can be found, for example, under the keyword steel in Ullmann's Encyclopedia of Industrial Chemistry, 6th ed., 1999 Electronic Release, Wiley-VCH, D-69451 Weinheim, Germany.

Low-nickel austenitic steels are desirable materials for a number of applications. An increasingly important field of use for such steels is for articles which are in contact with a human or animal body during their use, since of course these steels do not give rise to a nickel allergy. Nickel allergies are frequently the cause of contact eczemas or other allergic phenomena which occur on contact with nickel-containing steels, for example during the wearing of jewelry, watches or implants or when using medical instruments made of such steels. In many countries, limits are therefore being specified, or are already in force for the nickel content of materials or for their nickel release on contact with a human or animal body. It is also for this reason that it is becoming increasingly important to have very many low-nickel austenitic steels available for very many applications.

A number of low-nickel austenitic steels, including nickel-free ones, are known. As a rule, the austenitic structure in such steels is stabilized by the element nitrogen.

Thus, AT-B-266 900 discloses the use of austenitic, nonmagnetic steels for the production of moving machine parts, in particular those subjected to vibrational stresses, the steels to be used merely being defined in extremely wide ranges of possible compositions: from 0 to 20% by weight of Mn, from 0 to 30% by weight of Cr, from 0 to 5% by weight of Mo and/or V, at least 0.5, preferably at least 1.4, % by weight of N, from 0.02 to 0.55% by weight of C, from 0 to 2% by weight of Si and from 0 to 25% by weight of Ni, the remainder being iron. Said wide ranges cover different steels having completely different properties, criteria for choosing specific steels are not given, and there is just as little information regarding measures for the production of such steels.

EP-A-875 591 describes the use of a corrosion-resistant substantially nickel-free austenitic steel substantially comprising 5 to 26% by weight of Mn, 11–24% by weight of Cr, 2.5–6% by weight of Mo, 0.2–2.0% by weight of N, 0.1–0.9% by weight of C, and up to 0.5% by weight of Ni, the remainder being Fe, as a material for the production of articles which are in contact with living beings. DE-A-195 13 407 likewise describes the use of a corrosion-resistant substantially nickel-free austenitic steel as material for the production of articles which are in contact with living beings. This steel substantially comprises 2–26% by weight of Mn, 11–24% by weight of Cr, 2.5–10% by weight of Mo, 0.55–1.2% by weight of N, less than 0.3% by weight of C and up to 0.5% by weight of Ni, the remainder being Fe. JP-A-07/150297 (Chemical Abstracts: Abstract No. 123:175994) discloses a steel composed of 10–25% by weight of Mn, 10–25% by weight of Cr, 5–10% by weight of Mo, 0.2–1% by weight of N, 0.05–0.5% by weight of C and up to 0.5% by weight of Si, the remainder being Fe, and its use in shipbuilding. DE-A-196 07 828 describes a steel composed of 8–15% by weight of Mn, 13–18% by weight of Cr, 2.5–6% by weight of Mo, 0.55–1.1% by weight of N, up to 0.1% by weight of C and up to 0.5% by weight of Ni, the remainder being Fe, and its use for various components, in particular generator cap rings. In the case of the steels disclosed in said publications, the required high corrosion resistance is achieved with a comparatively large amount of molybdenum, by far the most expensive of the conventional alloy elements.

DE-A-42 42 757 proposes the use of a steel substantially comprising 21–35% by weight of Mn, 9–20% by weight of Cr, 0–7% by weight of Mo, 0.3–0.7% by weight of N, up to 0.015% by weight of C, up to 0.1% by weight of Ni, up to 0.5% by weight of Si, up to 0.02% by weight of P, up to 0.02% by weight of S and up to 4% by weight of Cu, the remainder being Fe, as a material for the production of articles which are in contact with living beings. EP-A-422 360 discloses the use of a steel composed of 17–20% by weight of Mn, 16–24% by weight of Cr, 0–3% by weight of Mo, 0.5–1.3% by weight of N and up to 0.20% by weight of C, the remainder being Fe, for the production of components on railway vehicles. EP-A-432 434 describes a process for the production of connecting elements from a steel composed of 17.5–20% by weight of Mn, 17.5–20% by weight of Cr, 0–5% by weight of Mo, 0.8–1.2% by weight of N, up to 0.12% by weight of C, 0.2–1% by weight of Si, up to 0.05% by weight of P, up to 0.015% by weight of S and up to 3% by weight of Ni, the remainder being Fe. DE-A-25 18 452 describes a process for the production of an austenitic steel comprising 21–45% by weight of Mn, 10–30% by weight of Cr and 0.85–3% by weight of N, the remainder being Fe, by nitriding a nitrogen-free or low-nitrogen master alloy at at least 925° C. Although the steels described in these publications have relatively low molybdenum content, they have a relatively high manganese content which adversely affects the corrosion properties.

DE-A-24 47 318 describes an austenitic steel comprising from 15 to 45% by weight of Mn, from 10 to 30% by weight of Cr, from 0.85 to 3% by weight of N, up to 1% by weight of C, from 0 to 2% by weight of Si and at least one of the following three alloy components: 1–3% by weight of Cu, 1–4% by weight of Ni and 1–5% by weight of Mo, the content of these last-mentioned components summing to 5% by weight and the remainder being iron, and it being necessary for the alloy composition to fulfill further specific conditions. Alternatively, the alloy may be free of Cu and Ni if a comparatively high manganese content of at least 21% by weight is used. In this steel, too it is therefore only possible to dispense with nickel if a comparatively high molybdenum or manganese content is accepted, and/or at least 1% by weight of copper is present.

EP-A-640 695 discloses a steel composed of 11–25% by weight of Mn, 10–20% by weight of Cr, up to 1% by weight of Mo, 0.05–0.55% by weight of N, up to 0.01% by weight of C, up to 0.5% by weight of Ni and up to 1% by weight of Si, the remainder being Fe, and its use for the production of commodities, which come into contact with the skin of living beings. JP-A-07/157847 describes a steel comprising 9–20% by weight of Mn, 12–20% by weight of Cr, 1–5% by weight of Mo, 0.1–0.5% by weight of N, 0.01–0.6% by weight of C, 0.05–2.0% by weight of Si, 0.05–4% by weight of Cu, the remainder being Fe, and its use for the production of watch cases. JP-A-06/116 683 (Chemical Abstracts: Abstract No. 121:138554) discloses a steel comprising 5–23% by weight of Mn, 13–22% by weight of Cr, up to 5% by weight of Mo, 0.2–0.6% by weight of N, 0.05–0.2% by weight of C, up to 0.1% by weight of In and up to 15% by weight of Ni, the remainder being Fe. The steels disclosed in these publications contain, at least in ranges of their possible combinations, comparatively little molybdenum and manganese, but their corrosion stability is unsatisfactory. Patent Abstracts of Japan, vol. 011, No. 069 (C407), a summary of JP-A-61/227 154, discloses a heat-resistant cast steel which contains 0.2–0.7% of C, 0.3–2% of Si, 8–25% of Mn, not more than 5% of Ni, 12–30% of Cr, 0.3–2.5% of Nb and 0.005–0.7% of N, the remainder being iron, and is derived from known steels by replacing nickel with a combination of Nb and N. U.S. Pat. No. 4,116,183 discloses an austenitic steel which, in addition to iron, contains 18.05–22% by weight of Cr, 6.0–10.5% by weight of Mn, 0.40–1.10% by weight of N, not more than 0.08% by weight of S, not more than 0.035% by weight of P, not more than 0.9% by weight of Si and not more than 3% by weight of Cu.

It is an object of the present invention to provide a low-nickel, preferably nickel-free, austenitic steel. For cost reasons too the steel should contain a comparatively small amount of other alloy elements; in particular, it should have a low content of molybdenum, manganese and copper and nevertheless have excellent material properties, in particular high corrosion resistance.

We have found that this object is achieved by a low-nickel austenitic steel which contains iron and the following components.

Manganese: less than 17.0% by weight;

Chromium: more than 21.0 and not more than 26.0% by weight;

Molybdenum: less than 1.50% by weight;

Nitrogen: more than 0.70 and not more than 1.70% by weight; and

Carbon: more than 0.11 and not more than 0.70% by weight.

We have furthermore found processes for the production of moldings from steel.

Data in % by weight relate to the composition of the prepared steel.

The novel steel has a low nickel content and is preferably nickel-free, austenitic, a corrosion-resistant material which is readily producible and processable and, especially because of the low molybdenum content, is also economical.

The novel steel has a low nickel content, i.e. nickel is added to it, if at all, only in comparatively small amounts or in general not more than 2, for example not more than 1, % by weight. The novel steel is preferably nickel-free, i.e. is free of intentionally added nickel. (Freedom from nickel is consequently a special case of the low nickel content.) Nickel is generally present in small amounts or traces as an unavoidable impurity, frequently owing to the general use of steel scrap as a raw material for obtaining iron or crude steel. In general, the novel steel in its nickel-free embodiment therefore conveys less than 1.0, preferably less than 0.5, particularly preferably less than 0.3, % by weight of nickel. A steel having such a low nickel content produces so little nickel, even in continuous contact with the human or animal body, that there is no fear of sensitization or allergies.

The novel steel contains less than 17.0, and preferably not more than 16% by weight of manganese. It furthermore contains more than 21.0 and not more than 26.0, preferably not more than 23, % by weight of chromium and less than 1.50 and preferably not more than 1.4 % by weight of molybdenum. Its nitrogen content is more than 0.70, preferably at least 0.82, and not more than 1.70% by weight; and its carbon content is more than 0.11, preferably at least 0.15, for example at least 0.17, and not more than 0.70% by weight. These alloy elements are present substantially in solid solution, i.e. finely divided in atomic form in the austenitic lattice, and not as carbides, nitrides or intermetallic phases.

The addition of a small amount of further alloy elements which are frequently used for improving specific properties for specific applications or as a conventional additive in steel production does not generally impair the material properties of the novel steel. In particular, it may contain copper in an amount of less than 4, for example less than 2.5, preferably less than 2 and particularly preferably not more than 1, for example 0.5, % by weight. It may also contain, for example, tungsten in an amount of less than 2 and preferably not more than 1% by weight, and silicon in an amount of less than 2 and preferably not more than 1% by weight.

In a particularly preferred embodiment, the novel steel consists of iron, unavoidable impurities and the following components:

Manganese: less than 17.0% by weight;

Chromium: more than 21.0 and not more than 26.0% by weight;

Molybdenum: less than 1.50% by weight;

Nitrogen: more than 0.70 and not more than 1.70% by weight;

Carbon: more than 0.11 and not more than 0.70% by weight;

Copper: less than 2.5% by weight;

Tungsten: less than 2% by weight; and

Silicon: less than 2% by weight.

The novel steel is extremely corrosion-resistant. The corrosion resistance, expressed as critical crevice corrosion temperature increases with the following effective sum of alloy elements:

$$\text{Effective sum}=Cr+3.3\ Mo+20\ C+20\ N-0.5\ Mn,$$

where the element symbol is the content of this element in % by weight in the steel. In applications where the corrosion resistance of the steel is important, the composition of the steel is therefore optimized to obtain a very high effective sum within the limits prescribed by its other required material properties (strength, ductility, etc.). In these cases, a low manganese content and high carbon and nitrogen content with moderate chromium and molybdenum content are preferred.

Workpieces comprising the novel steel have a wide range of uses. (Since the novel steel is an object and therefore always has a geometric shape, the terms "the steel" and "a workpiece or article comprising this steel" generally have the same meaning.)

Workpieces comprising the novel steel are used in particular where high corrosion resistance and/or strength are required and/or release of nickel cannot be tolerated. A typical field of use for the novel steel is the production of articles which are in at least in occasional contact with the human or animal body, for example spectacles, watches, jewelry, implants, dental implants, metallic parts in clothing, for example belt fasteners, hooks, eyes, needles, safety needles, bed frames, railings, handles, scissors, cutlery and medical instruments, such as injection needles, scalpels or other surgical instruments.

However, the surprisingly high corrosion resistance and strength of the novel steel also opens up applications where freedom from nickel plays no role or only a minor role. It is used, for example, in building construction and civil engineering, for example for the production of reinforcing steel, fastening elements, anchoring elements, hinges, rock anchors, load-bearing structures, facade elements or prestressing steel. It is also used as material for the production of industrial apparatuses, for example apparatuses or pipelines in oil and natural gas exploration and production, and the associated ocean engineering as well as in shipbuilding, or in the petrochemical industry. Furthermore, it is used as material in transport technology, for example for components or installations and means of transport for water, land and air transport. Furthermore, it is used in mechanical engineering and plant construction, for example for energy and power station technology or for electrical and electronic equipment. The novel steel is moreover used as a metallic binder phase for hard substances in hard sintered moldings.

For some of said applications, in particular where ferromagnetism presents no problems, it may be sufficient to apply or produce the novel steel only as a surface layer. Processes for this purpose are known, for example the plating of a workpiece with a thin coating of the novel steel, or only partial nitriding of a workpiece comprising a nitrogen-free or relatively low-nitrogen master alloy.

The novel steel is produced and/or shaped into the desired workpiece by known steel production methods, for example by pressureless smelting, electroslag resmelting, pressure electroslag resmelting, pouring of the melt, forging, hot and/or cold forming, powder metallurgy, for example pressing and sintering, or powder injection molding, both of which are possible using a powder of uniform novel composition or by the known master alloy technique, or, if required, with subsequent nitriding of a nitrogen-free or low-nitrogen master alloy, if said melt metallurgical and powder metallurgical processes were not carried out under sufficient nitrogen partial pressure. The formation of carbides, nitrides and intermetallic phases is avoided or eliminated by heat treatment in a manner which is also known. Particularly high strength of workpieces comprising the novel steel is achieved by solution heat treatment and cold forming. If desired, the workpiece is then tempered. Surprisingly, cold forming does not adversely affect the resistance to crevice corrosion.

A preferred process for the production of articles consisting of the novel steel is powder metallurgy. For this purpose, a powder comprising the novel steel or a nitrogen-free or relatively low-nitrogen master alloy is introduced into a mold, for example by pressing, removed from the mold and sintered. During the sintering or in a subsequent additional process step, the required nitrogen content is established by nitriding if a nitrogen-free or relatively low-nitrogen master alloy was used.

It is not absolutely essential to use the steel or its nitrogen-free or relatively low-nitrogen precursor in the form of a uniform alloy. The components of the steel or of its precursor may also be present in the form of a pulverulent mixture of the alloy elements or as a mixture of different alloys and/or pure elements, from which an alloy of the desired gross composition form by the master alloy technique during the sinter process as a result of diffusion. For example, a mixture of pure iron powder and an alloy powder which contains the other alloy elements and, if desired, also iron may be used.

A substantial disadvantage of simple powder metallurgical shaping processes, for example pressing in a mold, is that only moldings having a comparatively simple external shape can be produced thereby. Another known powder metallurgical process which is suitable in particular for the production of moldings having a complex geometry is powder injection molding. For this purpose, the steel powder, a nitrogen-free or relatively low-nitrogen precursor, is mixed with a thermoplastic, which is usually referred to as a binder in powder injection molding technology, and, if required, further assistants, so that overall a thermoplastic injection molding material (feedstock) forms.

The thermoplastic injection molding material is injection molded in a mold using the injection molding technology known from the processing of thermoplastics, the thermoplastic powder injection molding binder is then removed from the injection molded body (green compact), and the body (brown compact) freed from this binder is sintered to give the finished sintered molding and, if required, the desired nitrogen content is established by nitriding by means of a heat treatment in a nitrogen-containing furnace atmosphere. Preferably, the nitrogen content is established by nitriding during the sintering or immediately before or after it, without immediate removal of the sintered molding from the sinter furnace or cooling below the sinter temperature or the nitriding temperature. The main problem in these processes is the binder removal, which is usually carried out thermally by pyrolysis of the thermoplastic, cracks frequently forming in the workpiece. A thermoplastic which can be removed catalytically and at low temperature is therefore advantageously used.

Metal powder injection molding processes suitable for the production and processing of the novel steel and feedstock for this purpose are known to a person skilled in the art. For example, EP-A 413 231 describes a catalytic binder removal process, and EP-A 465 940 and EP-A 446 708 disclose feedstocks for the production of the metallic moldings. W.-F. Bähre, P. J. Uggowitzer and M. O. Speidel: "Competitive Advantages by Near-Net-Shape-Manufacturing" (Editor H.-D. Kunze), Deutsche Gesellschaft für Metallurgie, Frankfurt, 1997 (ISBN 3-88355-246-1), and H. Wohlfromm, M. Blömacher, D. Weinand, E.-M. Langer and M. Schwarz: "Novel Materials in Metal Injection Molding", Proceedings of PIM-97—1st European Symposium on Powder Injection Moulding, Munich Trade Fair Centre, Munich, Germany, Oct. 15–16, 1997, European Powder Metallurgy Association 1997, (ISBN 1-899072-05-5) describe powder injection molding processes for the production of nickel-free nitrogen-containing steels with nitriding during the sintering process. International Patent Application PCT/EP/99/09136 (date of international filing Nov. 25, 1999 Priority Application DE 19855422.2 of Dec. 1, 1998) describes a process for the production of hard sintered moldings comprising nickel-free austenitic steel as a metallic binder phase of the hard substances.

The powder injection molding process differs in procedure from conventional powder metallurgical processes, such as pressing and sintering, in the method of shaping the consequent additional step for removal of the thermoplastic powder injection molding binder used for shaping. In all powder metallurgical processes, however, sintering and nitriding are carried out in the same manner.

The novel steel, its precursor or its component are used in the form of fine powder. The mean particle sizes used are usually less than 100, preferably less than 50, particularly preferably less than 20, micrometers and in general greater than 0.1 micrometer. Such metal powders are commercially available or can be produced in any known manner, for example by carbonyl decomposition or water or gas atomization.

For carrying out the powder injection molding process, the novel steel, its precursor or its components is or are mixed with a thermoplastic, nonmetallic material as a powder injection molding binder, and the powder injection molding material is thus produced. Suitable thermoplastics for the production of injection molding materials are known. In general, thermoplastics are used, for example polyolefins, such as polyethylene or polypropylene, or polyethers, such as polyethylene oxide (polyethylene glycol). The use of those thermoplastics which can be removed from the green compact catalytically at comparatively low temperature is preferred. The polyester plastic is preferably used as the basis of the thermoplastic, particularly preferably polyoxymethylene (POM, paraformaldehyde, paraldehyde). If desired, assistants for improving the processing properties of the injection molding material are also mixed with the latter, for example dispersants. Comparable thermoplastic materials and processes for their preparation and processing by injection molding and catalytic binder removal are known and are described, for example, in EP-A 413 231, EP-A 446 708, EP-A 444 475, EP-A 800 882 and in particular EP-A 465 940 and its US equivalent U.S. Pat. No. 5,362,791 which are hereby expressly incorporated by reference.

A preferred novel injection molding material consists of:

a) from 40 to 70% by volume of the steel defined in claim 1, 2 or 3, of a nitrogen-free or relatively low-nitrogen precursor of this steel or of a mixture as components of the steel or of its precursor, in powder form having a mean particle size of 0.1 micrometer and not more than 100, preferably not more than 50, particularly preferably not more than 20, micrometers;

b) from 30 to 60% by volume of a mixture of b1) from 50 to 100% by weight of a polyoxymethylene homo- or copolymer and b2) from 0 to 50% by weight of a polymer which is immiscible with b1) and can be removed thermally without leaving a residue, or a mixture of such polymers, as a thermoplastic binder of the powder a), and c) from 0 to 5% by volume of a dispersant.

Of course, the component sum to 100% by volume.

The polyoxymethylene homo- and copolymers and their preparation are known to a person skilled in the art and are described in the literature. The homopolymers are usually prepared by polymerization (generally catalyzed polymerization) of formaldehyde or trioxane. For the preparation of polyoxymethylene copolymers, a cyclic ether or a plurality of cyclic ether is or are conveniently used as a comonomer together with the formaldehyde and/or trioxane in the polymerization, so that the polyoxymethylene chain with its sequence of (—$OCH_2$) units is interrupted by units in which more than one carbon atom is arranged between two oxygen atoms. Examples of cyclic ethers suitable as comonomers are ethylene oxide, 1,2-propylene oxide, 1,2-butylene oxide, 1,3-dioxane, 1,3-dioxolane, dioxepan, linear oligo- and polyformals, such as polydioxolane or polydioxepan, and oxymethylene terpolymers.

Suitable components b2) are in principle polymers which are immiscible with the polyoxymethylene homo- or copolymer b1). Such polymers and their preparation are known to a person. skilled in the art and are described in the literature.

Preferred polymers of this type are polyolefins, vinylaromatic polymers, polymers of vinyl esters of aliphatic $C_1$–$C_8$-carboxylic acids, polymers of vinyl alkyl ethers having 1 to 8 carbon atoms in the alkyl group or polymers of methacrylates having at least 70% by weight of units which are derived from methacrylates or mixtures thereof.

Suitable polyolefins are, for example, polymers of olefins of 2 to 8, in particular 2, 3 or 4, carbon atoms and copolymers thereof. Polyethylene and polypropylene and copolymers thereof are particularly preferred. Such polymers are mass-produced products, or widely used commercial products and therefore known to a person skilled in the art. Suitable vinylaromatic polymers are, for example, polystyrene and poly-α-methylstyrene and copolymers thereof with up to 30% by weight of comonomers from the group consisting of the acrylates, acrylonitrile and methacrylonitrile. Such polymers, too, are customary commercial products. Suitable polymers of vinyl esters of aliphatic $C_1$–$C_8$-carboxylic acids are, for example, polyvinyl acetate or polyvinyl propionate, and suitable polymers of $C_1$–$C_8$-vinyl alkyl ethers are, for example, polyvinyl methyl ether and polyvinyl ethyl ether. For example, copolymers with at least 70% by weight of methacrylates of $C_1$–$C_{14}$-alcohols, in particular methyl methacrylate and/or ethyl methacrylate, as monomer units are used as polymers of methacrylates with at least 70% by weight of units derived from methacrylates. For example, 0–30, preferably 0–20, % by weight of acrylates, preferably methyl acrylate and/or ethyl acrylate may be used as other comonomers.

Component c) is a dispersant. Dispersants are widely used and are known to a person skilled in the art. In general, it is possible to use any dispersant which improves the homogeneity of the injection molding material. Preferred dispersants are oligomeric polyethylene oxide having an average molecular weight of from 200 to 400, stearic acid, hydroxystearic acid, fatty alcohols, fatty alcohol sulfonates and block copolymers of ethylene oxide and propylene oxide. A mixture of different substances having dispersing properties may also be used as dispersants.

The metal powder—in the powder injection molding process after prior mixing with the thermoplastic binder and, if required, with the assistants—is brought by means of a shaping tool, for example a press, into a form which very closely approaches its desired final geometric shape, in order to avoid any expensive subsequent processing of the finished sintered molding. It is known that shrinkage of the workpieces, which is usually compensated by correspondingly larger dimensioning of the moldings prior to sintering, occurs during the sintering.

The molding of the powder injection molding feedstocks is effected in a conventional manner using customary injection molding machines. The moldings are freed from the thermoplastic powder injection molding binder in a conventional manner, for example by pyrolysis. The binder is preferably removed catalytically from the preferred novel injection molding material by heat-treating of the green compact in a known manner with an atmosphere containing a gaseous acid. This atmosphere is produced by vaporizing an acid with sufficient vapor pressure, conveniently by passing a carrier gas, in particular nitrogen, through a storage vessel containing an acid, advantageously nitric acid, and then passing the acid-containing gas into the furnace for binder removal. The optimum acid concentration in the furnace for binder removal is dependent on the desired steel composition and on the dimensions of the workpiece and is determined from case to case by routine experiments. In general, a treatment in such an atmosphere at from 20 to 180° C. over a period of from 10 minutes to 24 hours is sufficient for binder removal. After the binder removal any residues of a thermoplastic binder and/or of the assistants still present are pyrolyzed by heating up to sintering temperature, and thus completely removed.

After the shaping—and, in the injection molding process, subsequent removal of the binder—the molding is sintered in a sinter furnace to give the sintered molding and, if a nitrogen-free or low-nitrogen precursor of the novel steel was used, is brought to the desired nitrogen content by nitriding.

That composition of the furnace atmosphere which is optimum for sintering and, if required, for nitriding and the optimum temperature program depend on the exact chemical composition of the steel used or to be produced or of its precursor, in particular its nitrogen dissolution capacity, and on the particle size of the powders used. In general, both the increase in the nitrogen partial pressure in the furnace atmosphere and the reduction in the temperature are directly correlated with higher nitrogen contents in the steel. Since, however, a reduction in the temperature results not only in a slowing down of the sintering process itself but also in a reduction in the diffusion rate of the nitrogen in the steel the sintering and/or nitriding process takes correspondingly longer at lower temperature. That combination of furnace temperature, in particular the nitrogen partial pressure, temperature and duration of sintering and/or nitriding, which is optimum for achieving a specific desired nitrogen content in a homogeneous, dense sintered molding can readily be determined from case to case on the basis of a few routine experiments. Such sintering processes are described, for example, in the publications by Bähre et al. and Wohlfromm et al. These two publications were hereby expressly incorporated by reference.

Usually, nitrogen partial pressures in the furnace atmosphere of at least 0.1, preferably 0.25, bar are used. This nitrogen partial pressure is in general not more than 2, preferably not more than 1, bar. The furnace atmosphere may consist of pure nitrogen or of inert gases, such as argon, and/or reactive gases, such as nitrogen. In general, it is advantageous to use a mixture of nitrogen and hydrogen as the furnace atmosphere, in order to remove possible troublesome oxidic impurities of the metals. The hydrogen content, if present, is in general at least 5, preferably at least 15, % by volume and in general not more than 50, preferably not more than 30, % by volume. If desired this furnace atmosphere may additionally contain inert gases, for example argon. The furnace atmosphere should preferably be substantially dry and in general a dew point of −40° C. is sufficient for this purpose.

The (absolute) pressure in the sinter and/or nitriding furnace is usually at least 100, preferably at least 250, mbar. It is furthermore in general not more than 2.5, preferably not more than 2, bar. Particularly preferably, atmospheric pressure is employed.

The sintering and/or nitriding temperature is in general at least 1000° C., preferably 1050° C., particularly preferably at least 1100° C. It is furthermore in general not more than 1450° C., preferably not more than 1400° C., particularly preferably not more than 1350° C. The temperature can be varied during the sintering and/or nitriding process, for example first to dense-sinter the workpiece completely or substantially at a higher temperature and then to establish the desired nitrogen content at a lower temperature.

The optimum heating rates are readily determined by a few routine experiments and are usually at least 1° C., preferably at least 2° C., particularly preferably at least 3° C. per minute. For economic reasons, a very high heating rate is generally desirable in order to avoid an adverse effect on the quality of the sintering and/or nitriding, but a heating rate below 20° C. per minute is generally established. Under certain circumstances, it is advantageous, during the heating to the sintering and/or nitriding temperature, to maintain a waiting time at a temperature which is below the sintering and/or nitriding temperature, for example maintain a temperature of from 500 to 700° C., for example 600° C., over a period of from 30 minutes to two hours, for example one hour.

The duration of sintering and/or nitriding, i.e. the hold time at sintering and/or nitriding temperature, is generally established so that the sintering moldings are both sufficiently dense-sintered and sufficiently homogeneously nitrided. In the case of conventional sintering and/or nitriding temperatures, nitrogen partial pressures and molding sizes the duration of sintering and/or nitriding is generally at least 30, preferably at least 60, minutes. This duration of the sintering and/or nitriding process plays a role in determining the production rate and it is for this reason that the sintering and/or nitriding is preferably carried out in such a way that, from the economic point of view, the sintering and/or nitriding process does not take an unsatisfactorily long time. In general, the sintering and nitriding process. (without the heating and cooling phases) can be terminated after not more than 10 hours.

The sintering and/or nitriding process is terminated by cooling the sintered moldings. Depending on the composition of the steel, a specific cooling procedure may be necessary, for example very rapid cooling, in order to obtain high-temperature phases or to prevent separation of the components of the steel. In general, it is also desirable for economic reasons to cool very rapidly in order to achieve a high production rate. The upper limit of the cooling rate is reached when sintered moldings having defects, such as breaks, cracks or deformation, due to excessively rapid cooling occur in an amount which is economically unsatisfactory. Accordingly, the optimum cooling is readily determined in a few routine experiments. In general, it is advisable to use cooling rates of at least 100, preferably at least 200, °C. per minute. The sintered moldings can be quenched, for example in cold water or oil.

After sintering and/or nitriding any desired after treatment, for example solution heat-treatment and quenching in water or oil or hot isostatic pressing of the sintered moldings, may be carried out. Preferably, the sintered moldings are subjected to a solution heat-treatment by heat-treating them for at least 5, preferably at least 10, minutes and not more than 2 hours, preferably not more than one hour, at a temperature of at least 1000° C., preferably at least 1100° C., and not more than 1250° C., preferably not more than 1200° C., under inert gas, for example under nitrogen and/or argon, and then quenching them, for example in cold water.

EXAMPLES

Example 1

The critical crevice corrosion temperature was measured for twenty two steels of various composition within the following limits:

Manganese: less than 17.0% by weight;

Chromium: more than 21.0 and not more than 26.0% by weight;

Molybdenum: less than 1.50% by weight;

Nitrogen: more than 0.70 and not more than 1.70% by weight; and

Carbon: more than 0.11 and not more than 0.70% by weight; remainder iron and unavoidable impurities.

Said temperature is a measure of the resistance to local corrosion. In the figure, the experimental results are plotted as open circles against the effective sum of the steel tested:

$$\text{Effective sum}=\text{Cr}+3.3\ \text{Mo}+20\ \text{C}+20\ \text{N}-0.5\ \text{Mn},$$

where the element symbol is the content of this element in the steel in % by weight. As a comparison, the results obtained with steels differing from the abovementioned one through molybdenum content of more than 2.5% by weight were plotted as solid circles.

The comparison shows that, in spite of an extremely low molybdenum content, the novel steels are surprisingly just as corrosion-resistant (high critical crevice corrosion temperature) as steels having a substantially higher content of the expensive molybdenum.

Example 2

A ten kilogram batch of a steel composed of 23% by weight of chromium, 16% by weight of manganese, 1.4% by weight of molybdenum, 0.17% by weight of carbon and 0.82% by weight of nitrogen, the remainder being iron, was smelted in a vacuum induction furnace at 0.8 bar nitrogen pressure and was cast. After forging, solution heat-treatment at 1100° C. and quenching, the steel had a homogeneous austenitic structure. In this state, it had a yield point of 550 MPa. After cold forming with a 72% cross-sectional reduction, the steel achieves a yield point of 2480 MPa and, after subsequent tempering at 500° C. for one hour, a yield point of 2670 MPa.

Example 3

Example 2 was repeated but, after the quenching, cold forming with a 92% cross-sectional reduction was carried out, followed by tempering. This led to extremely high yield point of 3100 MPa.

The examples show that the novel steel is not only corrosion-resistant but also has a surprisingly high strength.

I claim:

1. A powder injection molding material containing a low-nickel austenitic steel which consists of iron, and the following components:

Manganese: less than 17.0% by weight;

Chromium: more than 21.0 and not more than 26.0% by weight;

Molybdenum: less than 1.50% by weight;

Nickel: less than 2% by weight;

Nitrogen: more than 0.70 and not more than 1.70% by weight;

Carbon: more than 0.11 and not more than 0.70% by weight;

Copper: less than 4% by weight;

Tungsten: less than 2% by weight; and

Silicon: less than 2% by weight a nitrogen-free or relatively low-nitrogen precursor of this steel or a mixture of the components of the steel or of its precursor, in powder form, and a thermoplastic binder.

2. A powder injection molding material as claimed in claim 1, consisting of:

a) from 40 to 70% by volume of the steel, of a nitrogen-free or relatively low-nitrogen precursor of this steel or a mixture of the components of the steel or its precursor, in powder form having a mean particle size of at least 0.1 micrometer and not more than 100 micrometers;

b) from 30 to 60% by volume of a mixture of:

b1) from 50 to 100% by weight of a polyoxymethylene homo- or copolymer and b2) from 0 to 50% by weight of a polymer which is immiscible with b1) and can be thermally removed without leaving a residue, or a mixture of such polymers, as a thermoplastic binder of the powder a), and c) from 0 to 5% by volume of a dispersant.

3. A process for the production of moldings from steel, comprising the process steps injection molding of the injection molding material efined in claim 2, binder removal and sintering.

4. A process as claimed in claim 3, wherein the binder is removed catalytically.

5. A process as claimed in claim 3, wherein the nitrogen content of the steel is established by nitriding during or after the sintering.

6. A powder injection molding material as claimed in claim 2, wherein the steel, its precursor or their compounds in powder form have a mean particle size of not more than 50 micrometers.

7. A powder injection molding material as claimed in claim 2, wherein the steel, its precursor or their compounds in powder form have a mean particle size of not more than 20 micrometers.

* * * * *

UNITED STATES PATENT AND TRADEMARK OFFICE

CERTIFICATE OF CORRECTION

PATENT NO. : 6,682,581 B1
DATED : January 27,2004
INVENTOR(S) : Markus Speidel

It is certified that error appears in the above-identified patent and that said Letters Patent is hereby corrected as shown below:

Column 12,
Line 51, “efined” should be -- defined --.

Signed and Sealed this

Twenty-ninth Day of June, 2004

JON W. DUDAS
*Acting Director of the United States Patent and Trademark Office*